United States Patent [19]

Crim

[11] Patent Number: 4,467,974

[45] Date of Patent: Aug. 28, 1984

[54] BATHROOM TISSUE DISPENSER

[76] Inventor: Frank T. Crim, R.R. #1, 16441 Airstrip Dr., Barryton, Mich. 49305

[21] Appl. No.: 466,113

[22] Filed: Feb. 14, 1983

[51] Int. Cl.[3] ..... B65H 19/00

[52] U.S. Cl. ..... 242/55.53; 242/75.2

[58] Field of Search ..... 242/55.53, 55.2, 75, 242/75.2, 76; 225/82, 84, 85, 88, 51, 52

[56] References Cited

U.S. PATENT DOCUMENTS 2,608,356 8/1952 McDonald et al. ..... 242/55.53

3,409,340 11/1968 Clark ..... 312/39

*Primary Examiner*—Leonard D. Christian

*Attorney, Agent, or Firm*—Malcolm R. McKinnon

[57] ABSTRACT

A dispenser for perforated bathroom tissue and the like, said dispenser including a housing defining a generally cubical chamber adapted to receive a roll of tissue, and a cover pivotally connected to the housing, the cover including a support member and a tension member mounted on said housing for combined pivotal and translatory movement between a dispensing position in which the support member and the tension member cooperate to define a dispensing guide path therebetween and a loading position in which the support member and the tension member define a loading slot having a relatively wide cross sectional area permitting easy insertion of a leader portion of the roll of tissue therethrough.

6 Claims, 4 Drawing Figures

FIG. 4.
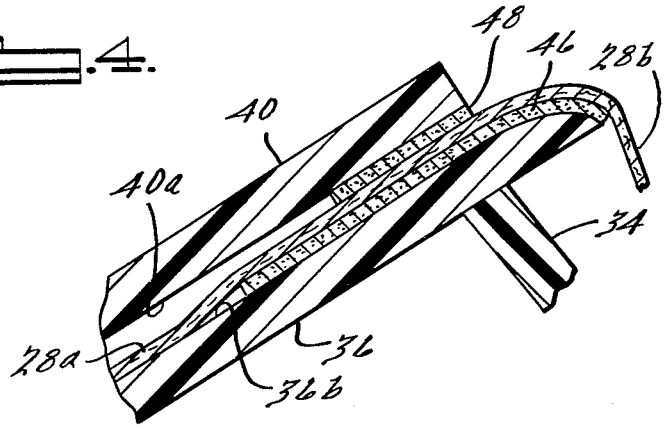
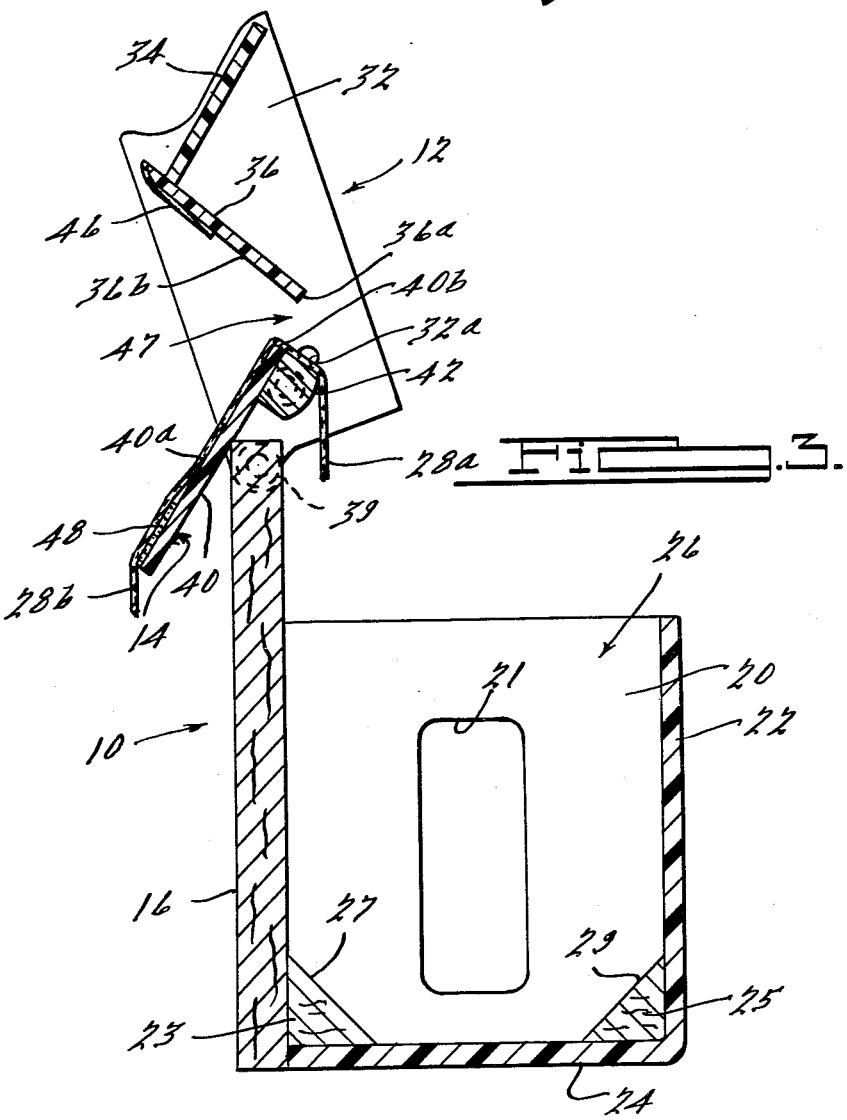
FIG. 3.

BATHROOM TISSUE DISPENSER

BRIEF SUMMARY OF THE INVENTION

This invention relates to dispensers, and, more particularly, to an improved dispenser particularly adapted for dispensing rolled, perforated bathroom tissue.

As is well known in the art, heretofore numerous prior devices have been devised and utilized for the purpose of storing and dispensing rolled paper, such as bathroom tissue and the like. The greatest majority of prior bathroom tissue dispensers have been devised for stationary installation, and are usually permanently installed in bathrooms, restrooms and the like. However, such prior devices have been deficient in a number of respects. For example, many prior dispensers are free rolling and over dispense the tissue with resultant waste of tissue, and such free rolling dispensers are also subject to the playful whims of children and animals, such as cats. Many prior dispensers are relatively complicated, become empty without warning to the user, or are difficult to reload, especially by users with physical disabilities, such as the very old and the very young, arthritics, and blind or otherwise disabled people. Other prior dispensers tend to under dispense the tissue thereby causing user frustration. Still other prior dispensers of the indicated character require installation in a recess in a wall, thereby causing disfiguration of the wall, and are often even more difficult to reload and use than dispensers of the type that project outwardly from the adjacent wall. Moreover, many prior dispensers, when installed in restrooms in public areas, such as campgrounds and highway rest stops, are often not properly maintained, are often vandalized and abused, inoperative, broken, empty or out of repair, with the result that persons desiring to use such facilities are required to carry the necessary tissue with them.

As is also well known in the art, heretofore various portable bathroom tissue dispensers have also been devised and utilized, such portable dispensers being intended to be carried by the users thereof whereby they may be used as needed. However, prior portable dispensers have tended to be relative complicated and/or expensive and/or have been deficient in other respects, such as being difficult to operate so as to dispense in the quantities desired, and/or are difficult to load, with the result that prior portable dispensers have failed to achieve significant acceptance in the marketplace.

An object of the present invention is to overcome disadvantages in prior dispensers of the indicated character and to provide an improved bathroom tissue dispenser that provides easy, positive and waste free dispensing of desired quantities of tissue.

Another object of the present invention is to provide an improved bathroom tissue dispenser incorporating improved means for dispensing under tension only the desired amount of rolled bathroom tissue.

Another object of the present invention is to provide an improved bathroom tissue dispenser which is adapted to be easily and quickly secured to a wall of a building, such as a residence or the like, without requiring special tools or unsightly modifications of existing wall surfaces, or which may be easily carried by a user whereby the dispenser will be readily available to the user.

Another object of the invention is to provide an improved bathroom tissue dispenser that is not subject to substantial child or animal misuse.

Another object of the present invention is to provide an improved bathroom tissue dispenser that is relatively simple in construction, economical to manufacture and assemble, durable, efficient and reliable in operation.

Still another object of the present invention is to provide an improved bathroom tissue dispenser that may be easily and quickly loaded for use and used without requiring unusual manual dexterity and/or eye-hand coordination and/or unusual intelligence.

Yet another object of the present invention is to provide an improved bathroom tissue dispenser in which the available supply of rolled bathroom tissue is readily apparent to the user both manually and visually.

The above as well as other objects and advantages of the present invention will become apparent from the following description, the appended claims, and the accompanying drawings.

BRIEF DESCRIPTION OF THE DRAWINGS

FIG. 3 is a cross sectional view of the dispenser illustrated in FIG. 1 and showing the same in its loading or open position; and FIG. 4 is an enlarged view of the portion of FIG. 2 within the circle 4.

DETAILED DESCRIPTION

Figure 1:
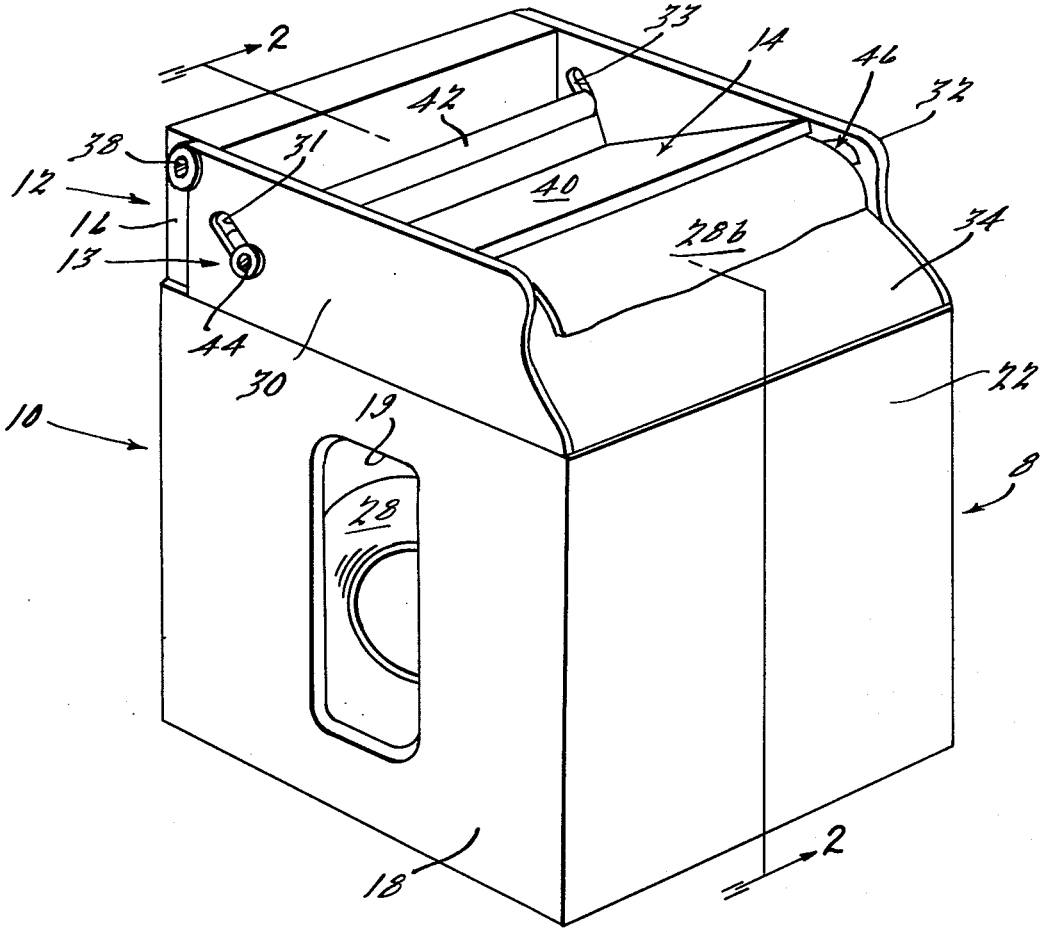
FIG. 1 is a perspective view of a bathroom tissue dispenser embodying the present invention, showing the same in its dispensing or closed position.

Referring to the drawings, a bathroom tissue dispenser, generally designated 8, embodying the present invention is illustrated therein, the dispenser 8 preferably being formed of plastic, wood, fiberglass or other suitable material having sufficient strength to withstand the forces exerted thereon and which may be given any desired color for decor purposes. The dispenser 8 includes a housing, generally designated 10, and a cover, generally designated 12, the cover 12 being comprised of a support member 13 hingedly connected to the housing, and a tension member 14 connected to the support member 13 for combined pivotal and translatory movement relative thereto. The housing 10 is of generally box like configuration and includes a back wall 16, side walls 18 and 20, a front wall 22 and a bottom wall 24, such walls being suitably joined together to form a unitary structure defining a generally cubical chamber 26 adapted to receive a roll of conventional perforated bathroom tissue 28. Vertically extending openings 19 and 21 are provided in the side walls 18 and 20, respectively, to facilitate a visual and/or manual indication of the amount of tissue remaining on the roll 28. A pair of generally prism shaped blocks 23 and 25, having inclined surfaces 27 and 29, respectively, are preferably fixed to the housing at the lower front and rear corners of the chamber 26 for the purpose of maintaining the roll 28 of tissue in a generally centered position within the chamber and to assure that sufficient tension is maintained on the tissue as it unrolls during the dispensing operation which will be described hereinafter in greater detail.

The support member 13 includes side walls 30 and 32, an inclined front wall 34, and an angularly disposed support wall 36, the support wall 36 preferably extending at an angle between 55 and 60 degrees and being oppositely angularly inclined with respect to the front wall 34. The rear wall 16 of the housing extends upwardly above the upper edges of the side and front walls of the housing, and the upper rear edge portion of the side walls 30 and 32 of the support member 13 are pivotally connected to the opposite sides of the rear wall 16 through the agency of a pair of pivot pins 38 and 39 whereby the support member is mounted on the housing for pivotal movement between the closed or dispensing position illustrated in FIGS. 1 and 2, and the open or loading position illustrated in FIG. 3. A pair of upwardly and rearwardly inclined guide slots 31 and 33 are provided in the side walls 30 and 32 at a location adjacent to, but spaced forwardly from, the rear edge portion of the support member 13. The tension member 14 includes a generally rectangular panel 40 and a mounting flange portion 42 fixed to the upper side of the panel 40 adjacent the rear edge thereof as view in FIGS. 1 and 2. The panel 40 is connected to the support member for combined pivotal and translatory movement relative thereto through the agency of a pair of pivot pins 44 and 45 which are slidably and pivotally received in the guide slots 31 and 33. The pivot pins 44 and 46 thus cooperate with the guide slots 31 and 33 to mount the tension member at its rear edge portion for pivotal movement about an axis disposed between the rear edge 37 of the support wall 36 and the rear of the support member 13 between a dispensing position in which the panel 40 overlies the support wall 36 to define a dispensing passageway therebetween, and a loading position in which the panel 40 is simultaneously pivoted and moved outwardly and rearwardly relative to the support wall 36. The distance between the opposing surfaces of the panel 40 and the support wall 36 may, for example, be approximately one-fourth inch in the dispensing position. The front portion of the upper surface **36*b* of the support wall 36 and the confronting front portion of the under surface 40*a* of the panel 40 are preferably provided with friction surfaces, as through the agency of strips such as 46 and 48** of a high friction material such as emery cloth, sand paper or the like to assure proper severance of the desired amount of tissue.

Figure 2:
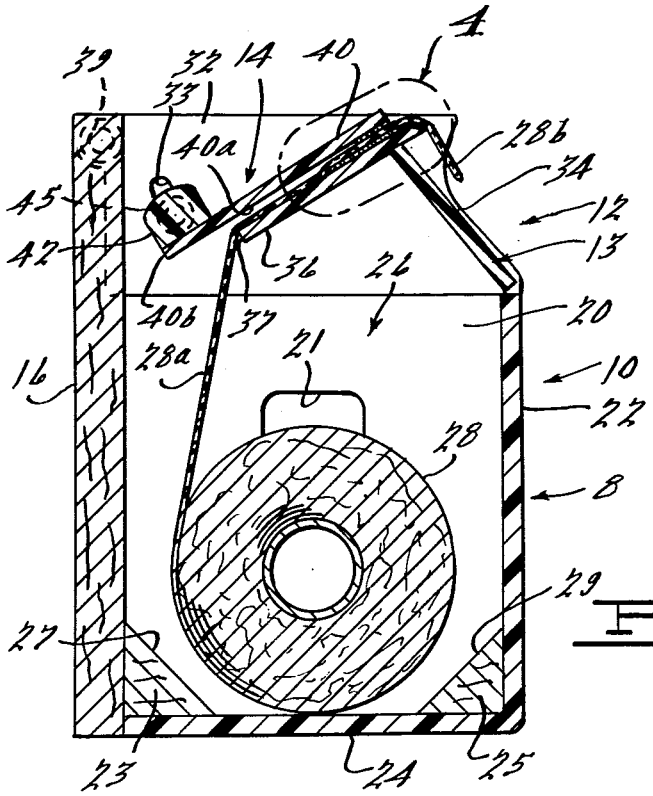
FIG. 2 is a cross sectional view of the dispenser illustrated in FIG. 1.

The various components of the dispenser 8 normally assume their dispensing positions illustrated in FIGS. 1 and 2. When it is desired to insert a roll 28 of bathroom tissue in the chamber 26 defined by the housing, the cover 12 is pivoted to its open position illustrated in FIG. 3. As the cover 12 is pivoted to its open position, the panel 40 pivots away from the support wall 36 under the force of gravity and assumes the position illustrated in FIG. 3 in which the rear edge **40*b* of the panel 40 cooperates with the rear edge 37 of the support wall 36 to define a loading passageway 47 through which the free end portion of the roll 28 may be threaded until enough leader 28*a* is pulled through to cover the under surface 40*a* of the panel 40 and provide a small overhang or access portion 28*b* extending beyond the strip 48. The upward pivotal movement of the cover 12 also serves to invert the guide slots 31 and 33 so that the tension member 14 drops downwardly due to the force of gravity to a position in which the pivot pins 44 and 45 are seated in the lower or bottom ends of the slots 31 and 33, respectively. This translatory movement of the tension member 14 has the effect of moving the rear edge 40*b* of the panel 40 away from the rear edge 36*a* of the support wall 36 and widening the loading slot 47 to facilitate threading of the leader portion 28*a*** of the tissue therethrough.

After the roll of tissue has been inserted in the chamber defined by the housing, the cover 12 is pivoted downwardly to its closed position, and as the cover moves to its closed position, the slots 31 and 33 are again inverted and the tension member 14 moves downwardly due to the force of gravity to a position in which the pivot pins 44 and 45 are again bottomed in the slots 31 and 33, as viewed in FIGS. 1 and 2, and the loading passageway 47 is narrowed. The tension member 14 may then be moved or flipped forwardly to its dispensing position illustrated in FIGS. 1, 2 and 4 in which the panel 40 overlies the support wall 36 to position the leader portion **28*a* of the tissue along the dispensing passageway defined between the support wall 36 and the panel 40 with the end of the leader of the tissue being frictionally engaged by and between the strips 46 and 48, and with the access portion 28*b*** projecting outside of the dispenser.

When a user desires to withdraw bathroom tissue from the dispenser, the access portion **28*b* is grasped and a pull is exerted along the angular line of action defined by the inner faces of the support wall 36 and the panel 40. When the desired amount of material has been withdrawn from the dispenser, the withdrawn strip may then be lowered and a downwardly directed pull exerted on the strip to cause it to tear at the perforations conventionally provided in the bathroom tissue nearest the strips 46 and 48. It will be noted that in such case, sufficient leader is left projecting beyond the strips 46 and 48** to provide an access strip for the next use. From the foregoing, it will be appreciated that dispensers embodying the present invention do not permit accidental infinite dispensing of paper since the paper is not free rolling and no significant inertial force is built up on the roll paper in the dispenser in the dispensing operation. It will also be appreciated that dispensers embodying the present invention are uniquely suited for dispensing bathroom tissue in an efficient operation and yet prevent unnecessary or undesired unrolling of the bathroom tissue. In addition, it will be appreciated that dispensers embodying the present invention are relatively easy to load, resistant to wasteful unwinding by animals or children or other careless users, and provide for economical dispensing of bathroom tissue with a minimum of effort on the part of the users.

While the invention has been described with reference to a portable dispenser, it will be apparent that dispensers embodying the present invention may be easily mounted on the wall of a residence or other building by merely provided mounting means which enables the back wall 16 of the dispenser to be secured, as for example, by screws, to the adjacent wall of the building.

While preferred embodiments of the invention have been illustrated and described, it will be understood that various change and modifications may be made without departing from the spirit of the invention.

What is claimed is:

1. A dispenser for rolled, perforated paper and the like, said dispenser comprising, in combination, a housing defining a chamber adapted to receive a roll of perforated paper, a cover for said housing, said cover including a support member hingedly connected to said housing for pivotal movement relative thereto to an open position permitting insertion of a roll of paper into the chamber defined by said housing, and a tension member carried by said support member and moveable relative to said support member between a loading position in which said tension member and said support member cooperate to define a relatively wide loading passageway through which a leader from a roll of paper may be threaded, and a dispensing position in which said tension member and said support member cooperate to define a relatively narrow dispensing passageway, said support member including an angularly inclined support surface, said tension member including a panel portion adapted to overlie said support surface when said cover is disposed in the dispensing position.

2. The combination as set forth in claim 1 including friction means carried by said support member and by said tension member, said friction means engaging said paper when said cover is disposed in the dispensing position.

3. The combination as set forth in claim 2 including means mounting said tension member for translatory movement relative to said support member.

4. A dispenser for rolls of bathroom tissue and the like, said dispenser comprising, in combination, a housing defining a generally cubical chamber adapted to receive a roll of bathroom tissue, a cover for said housing, means pivotally connecting said cover to said housing, said cover comprising a support member and a tension member, means pivotally connecting said tension member to said support member for combined pivotal and translatory movement relative thereto, whereby said tension member may be moved to both a loading position and a dispensing position relative to said support member.

5. The combination as set forth in claim 4 including friction means carried by said support member and by said tension member and adapted to engage a leader of a roll of tissue when said tension member is disposed in the dispensing position.

6. A dispenser for rolls of perforated bathroom tissue, said dispenser comprising, in combination, a housing defining a chamber adapted to receive a roll of bathroom tissue, a cover for said housing, said cover being pivotally movable between a closed dispensing position and an open loading position, said cover including a support member and a tension member, said tension member being carried by said support member, said tension member being movable relative to said support member between a dispensing position in which said tension member overlies a support surface on said support member to define a dispensing passageway therebetween for a leader of a roll of tissue, and a loading position in which said tension member is moved away from said support surface to define a loading slot in cooperation with said support member, and means operative in response to movement of said tension member to said open position to move said tension member to said loading position whereby a roll of tissue may be inserted into said chamber and a leader from said roll threaded through said loading slot whereafter said tension member may be moved to its closed position to position the leader between said tension member and said support member for dispensing movement.

* * * * *